US006250271B1

(12) United States Patent
Ikuma et al.

(10) Patent No.: US 6,250,271 B1
(45) Date of Patent: Jun. 26, 2001

(54) DECOMPRESSION DEVICE OF A FOUR-STROKE-CYCLE INTERNAL COMBUSTION ENGINE

(75) Inventors: Tomonori Ikuma; Nobuo Suzuki, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/512,792

(22) Filed: Feb. 25, 2000

(30) Foreign Application Priority Data

Mar. 9, 1999 (JP) ..... 11-061586

(51) Int. Cl.[7] ..... F01L 13/08
(52) U.S. Cl. ..... 123/182.1
(58) Field of Search ..... 123/182.1

(56) References Cited

U.S. PATENT DOCUMENTS 5,402,759 * 4/1995 Ding et al. ..... 123/182.1

FOREIGN PATENT DOCUMENTS 9-49408 2/1897 (JP) .

* cited by examiner

*Primary Examiner*—Andrew M. Dolinar
(74) *Attorney, Agent, or Firm*—Armstrong, Westerman, Hattori, McLeland & Naughton, L L P

(57) ABSTRACT

A small and light decompression device of a four-stroke-cycle engine which cancels decompression operation surely when the engine rotational speed exceeds a predetermined speed to enable a stable engine starting. The device comprises an axial hole formed in a cam shaft, an oil pressure chamber formed in the axial hole, a decompression shaft reciprocating in accordance with oil pressure in the oil pressure chamber, a decompression pin which drives an exhaust valve to open in the compression stroke when the decompression shaft positions at a first position and stops the opening drive of the exhaust valve when the decompression shaft positions at a second position, a weight rotating in accordance with the engine rotational speed, and an oil pressure control valve interlocked with the weight to open and close a leak hole for controlling oil pressure in the oil pressure chamber.

5 Claims, 5 Drawing Sheets

DECOMPRESSION DEVICE OF A FOUR-STROKE-CYCLE INTERNAL COMBUSTION ENGINE

BACKGROUND OF THE INVENTION

The present invention relates to a decompression device of a four-stroke-cycle internal combustion engine to be mounted on an outboard motor for example, for reducing compression pressure of a cylinder in a compression stroke to facilitate starting of the engine.

Some four-stroke-cycle internal combustion engines having manual starting devices such as a recoil starter are provided with decompression devices for reducing compression pressure of a cylinder in a compression stroke to facilitate starting of the engine. A decompression device having a decompression pin provided in a cam shaft to project radially outward of the cam shaft has been known. According to this decompression device, when an engine is to be started, the decompression pin projecting radially outward of the cam shaft opens an exhaust valve by a small lift in the compression stroke to reduce compression pressure in a cylinder.

For example, in a decompression device of an internal combustion engine disclosed in Japanese Laid-Open Patent Publication No. 9-49408, a decompression shaft is rotated to project a decompression pin by centrifugal force. This internal combustion engine is a four-stroke-cycle internal combustion engine mounted on an outboard motor and has a recoil starter. The decompression device has a decompression shaft rotatably provided within a cam shaft, a decompression pin and a centrifugal clutch mechanism. The decompression shaft is formed with a cut at a part of the outer periphery near an exhaust cam and a pin hole is formed on a cam shaft at a position opposite to the cut. Into the pin hole is inserted a decompression pin slidably in a radial direction of the cam shaft. The centrifugal clutch mechanism is provided on an outside part of a cam shaft pulley which is connected with a crankshaft pulley by a timing belt wound round the pulleys, and has a pair of weights rotatably supported by support pins. The weight is rotated by centrifugal force acting on it to swing outward against force of a spring, and at that time, the decompression shaft engaging with the weight rotates within the cam shaft.

In the above-mentioned decompression device, when the engine is started, the engine rotational speed is low and the centrifugal force acting on the weight is small, so that the weight does not rotate against the spring force. In this state, since the decompression pin touches an outer peripheral part of the decompression shaft having no cut formed, a tip end part of the decompression pin projects by a predetermined length from a surface of the cam shaft corresponding to a base circle part of the cam, so that the exhaust valve is opened a little in the compression stroke to release compression pressure.

When the engine has been started, the engine rotational speed rises and the weight is rotated by centrifugal force, and at the same time, the decompression haft engaging with the weight rotates until the cut reaches a position opposite to the decompression pin. In that state, the decompression pin fits in the cut so as not to project from the surface of the cam shaft, therefore the exhaust valve is never opened in the compression stroke.

Japanese Laid-Open Patent Publication No. 8-21221 discloses a pressure reducing device (decompression device) of an internal combustion engine in which a working shaft (decompression shaft) is reciprocated by oil pressure to move a pin (decompression pin). The pressure reducing device has the working shaft provided within a cam shaft so as to reciprocate in the axial direction, the pin and a piston. The pin is fixed to the working shaft in a state that the pin projects from a cylindrical surface (base circle part) of an exhaust cam portion, and accommodated in a slot formed in the cam shaft. The piston receives oil pressure generated in an oil pump driven by the engine to touch an end of the working shaft and displace the shaft axially against force of a coil spring.

In this pressure reducing device, when the engine is started, the engine rotational speed is low and oil pressure acting on the piston is low, so that the working shaft does not displace against the spring force even if the piston touches the working shaft. In this state, since the pin is positioned at an end of the slot near the exhaust cam portion projecting from the cylindrical surface, the exhaust valve is opened a little by the pin in the compression stroke to reduce the compression pressure.

When the engine has been started, the engine rotational speed increases and the oil pressure generated in the oil pump increases, so that the piston displaces the working shaft axially against the spring force. In this state, the pin is positioned at an end of the slot remote from the exhaust cam portion, so that the pin engages with no rocker arm and the exhaust valve is not opened in the compression stroke.

Regarding the decompression device utilizing centrifugal force acting on the weight to move the decompression pin, though the decompression action can be canceled when the engine rotational speed exceeds a set value, in order to ensure the cancel it is necessary to obtain necessary working force by making the weigh heavy or lengthening the moment arm of the weight, therefore the weight is apt to be large-sized. Accordingly, in this decompression device, a larger space must be ensured around the cam shaft within a cylinder head compared with the decompression device utilizing oil pressure, so that the engine is caused to be larger and heavier.

Regarding the decompression device utilizing oil pressure generated in the oil pump driven by the engine to move the decompression pin, the decompression action is canceled when the oil pressure exceeds a set value and the device is small and light. However, in this decompression device, it is difficult to cancel the decompression action irrespective of oil temperature when engine rotational speed exceeds a set value

SUMMARY OF THE INVENTION

The present invention has been accomplished in view of the foregoing, and an object of the invention is to provide a decompression device which is small and light, and further capable of canceling the decompression action surely when the engine rotational speed exceeds a set value to enable a stable starting of the engine.

The present invention provides a decompression device of a four-stroke-cycle internal combustion engine, comprising a cam shaft having an exhaust cam for driving an exhaust valve to open and formed with an axial hole; an oil pressure chamber formed in the axial hole to be supplied with pressure oil; a decompression shaft fitted in the axial hole to be positioned at one of a first position and a second position corresponding to oil pressure in the oil pressure chamber; a decompression pin which drives the exhaust valve to open in compression stroke of the engine when the decompression shaft is positioned at the first position and stops to drive the exhaust valve when the decompression shaft is positioned at the second position; and an oil pressure control valve by which oil pressure in the oil pressure chamber is set to a pressure for positioning the decompression shaft at the first position when rotational speed of the engine is below a specific starting rotational speed or to a pressure for positioning the decompression shaft at the second position when rotational speed of the engine is above the specific starting rotational speed.

According to the invention, since opening drive of the exhaust valve through the decompression pin is controlled by the decompression shaft of which position is controlled by oil pressure, the decompression device can be made smaller and lighter compared with a decompression device in which a decompression pin is moved by centrifugal force acting on a weight. Oil pressure in the oil pressure chamber is controlled by the oil pressure control valve which acts responding to engine rotational speed, and when the engine rotational speed exceeds the specific starting rotational speed, the oil pressure control valve acts to control oil pressure in the oil pressure chamber to a pressure for positioning the decompression shaft at the second position, so that opening drive of the exhaust valve by the decompression pin is stopped to cancel the decompression action surely at the specific engine rotational speed. Therefore, the engine can be started stably.

The oil pressure chamber may have a leak hole for discharging pressure oil in the oil pressure chamber to an outside of the cam shaft, and the oil pressure control valve may open the leak hole when the engine rotational speed is below the specific starting rotational speed and close the leak hole when the engine rotational speed is above the specific starting rotational speed. Generation and release of oil pressure in the oil pressure chamber can be carried out easily only by opening and closing the leak hole and the pressure oil discharged through the leak hole can be utilized for lubrication of a neighborhood of the cam shaft.

The oil pressure control valve may be interlocked with a weight rotatively supported by a support pin fixed to the cam shaft to be rotated by centrifugal force generated in accordance with the engine rotational speed, thereby, the leak hole is opened by movement of the weight when the engine rotational speed is below the specific starting rotational speed, and closed by movement of the weight when the engine rotational speed is above the specific starting rotational speed. The oil pressure control valve can be operated in accordance with engine rotational speed by a simple structure utilizing the weight. Since the weight is only required to drive the oil pressure control valve, the weight can be made small, therefore the decompression device can be made small and light in spite of using a weight.

The decompression pin may be inserted in a pin hole formed in the cam shaft radially, the decompression shaft may be able to reciprocate axially and have an annular groove formed in a position opposing to the pin hole when the decompression shaft positions at the second position, further the decompression pin may touch an outer periphery of the decompression shaft to project radially outward of a base circle part of the exhaust cam when the decompression shaft is at the first position, and fit in the annular groove to retreat radially inward of the base circle part when the decompression shaft is at the second position. Since the groove formed on the decompression shaft for engaging with the radially projecting decompression pin is annular, the decompression pin can surely fit in the annular groove regardless of rotational position of the decompression shaft with respect to the cam shaft. Therefore, the decompression shaft is required to be adjusted its axial position only.

The oil pressure chamber may be supplied with pressure oil from an oil pump driven by the engine through a throttle member. By setting discharge of pressure oil from the leak hole and discharge of pressure oil supplied into the oil pressure chamber through the throttle member from the oil pump generating oil pressure proportional to the engine rotational speed suitably, even if the oil pressure generated in the oil pump reaches a value capable of moving the decompression shaft before the engine rotational speed reaches the specific starting rotational speed, when the oil pressure control valve opens the leak hole, the oil pressure in the oil pressure chamber can be easily set at a value capable of positioning the decompression shaft at the first position, and when the oil pressure control valve closes the leak hole, the oil pressure in the oil pressure chamber can be swiftly set at a value capable of positioning the decompression shaft at the second position.

In this specification, the starting rotational speed means an engine rotational speed at which an internal combustion engine started by a starting device become capable of self-operation after complete combustion. The specific starting rotational speed means a starting rotational speed predetermined for canceling a decompression action of a decompression device.

DETAILED DESCRIPTION OF PREFERRED EMBODIMENT OF THE INVENTION

Hereinafter, a preferred embodiment of the present invention will be described with reference to FIGS. 1 to 7. The embodiment is a decompression device of a four-stroke-cycle two-cylinder internal combustion engine with recoil starter to be mounted on an outboard motor.

Figure 1:
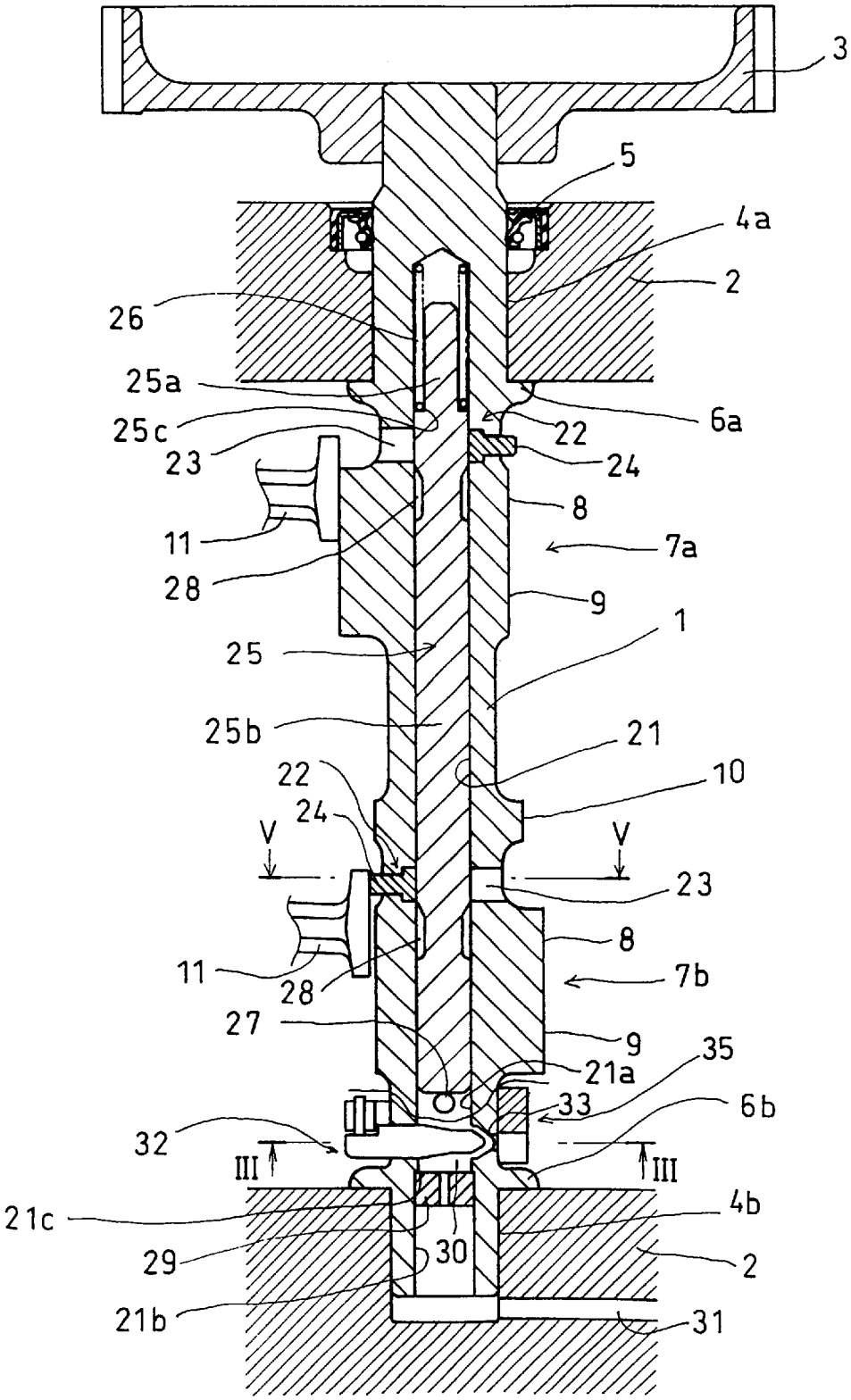
FIG. 1 is a sectional view of a decompression device of a four-stroke-cycle internal combustion engine according to a preferred embodiment of the invention showing its decompression state.

As shown in FIG. 1, a vertically extending cam shaft 1 provided in a cylinder head 2 has a driven pulley 3 attached at an end. A vertically extending crankshaft (not shown) has a drive pulley at an end. A timing belt is wound round the driven pulley 3 and the drive pulley so that the cam shaft 1 is rotated synchronously with the crankshaft by a torque of the crankshaft transmitted to the cam shaft 1 through the timing belt.

The cam shaft 1 has an upper journal 4*a* formed beneath the driven pulley 3 neighboring it and an lower journal 4*b* formed at a lower end of the cam shaft 1. The cam shaft 1 is rotatably supported by the cylinder head 2 at the journals 4*a*, 4*b*. An oil seal 5 is provided between a periphery of an upper portion of the upper journal 4*a* and the cylinder head 2. At a lower end of the upper journal 4*a* is formed a flange-like upper thrust receiving part 6*a* touching the cylinder head 2 to prevent upward movement of the cam shaft 1, and at an upper end of the lower journal 4*b* is formed a flange-like lower thrust receiving part 6*b* touching the cylinder head to prevent downward movement of the cam shaft 1.

The cam shaft 1 has an upper cam forming part 7*a* and a lower cam forming part 7*b* formed between both the thrust receiving parts 6*a*, 6*b* corresponding to two cylinders respectively. Each of the cam forming parts 7*a*, 7*b* has an arcuate base circle part having the center on axis of the cam shaft and a nose part projecting radially outward from the base circle part. In each cam forming part 7*a*, 7*b*, an exhaust cam 8 is formed at an axially upper portion and a suction cam 9 is formed at an axially lower portion. Between the cam forming parts 7*a*, 7*b* is formed a cam 10 for driving a fuel pump of the internal combustion engine.

The cylinder head is provided with a suction valve and a exhaust valve to every cylinders. Corresponding to the suction valve and the exhaust valve, a suction rocker arm and an exhaust rocker arm 11 are supported rotatably by rocker arm shafts, with phase difference of about 90 degrees (or about 270 degrees). In this embodiment, since one cam profile is used in common for the exhaust cam 8 and the suction cam 9, slipper faces of the rocker arms are disposed with the above-mentioned phase difference.

When the cam shaft 1 is rotatively driven by the torque of the crankshaft transmitted through the timing belt, the suction cam 9 and the exhaust cam 8 touching respective ends of the suction rocker arm and the exhaust rocker arm 11 rotate the rocker arms respectively, and the suction valve and the exhaust valve touching respective other ends of the suction rocker arm and the exhaust rocker arm 11 are driven to open with lifts corresponding to projecting length of the nose parts of the cams 8, 9.

Figure 2:
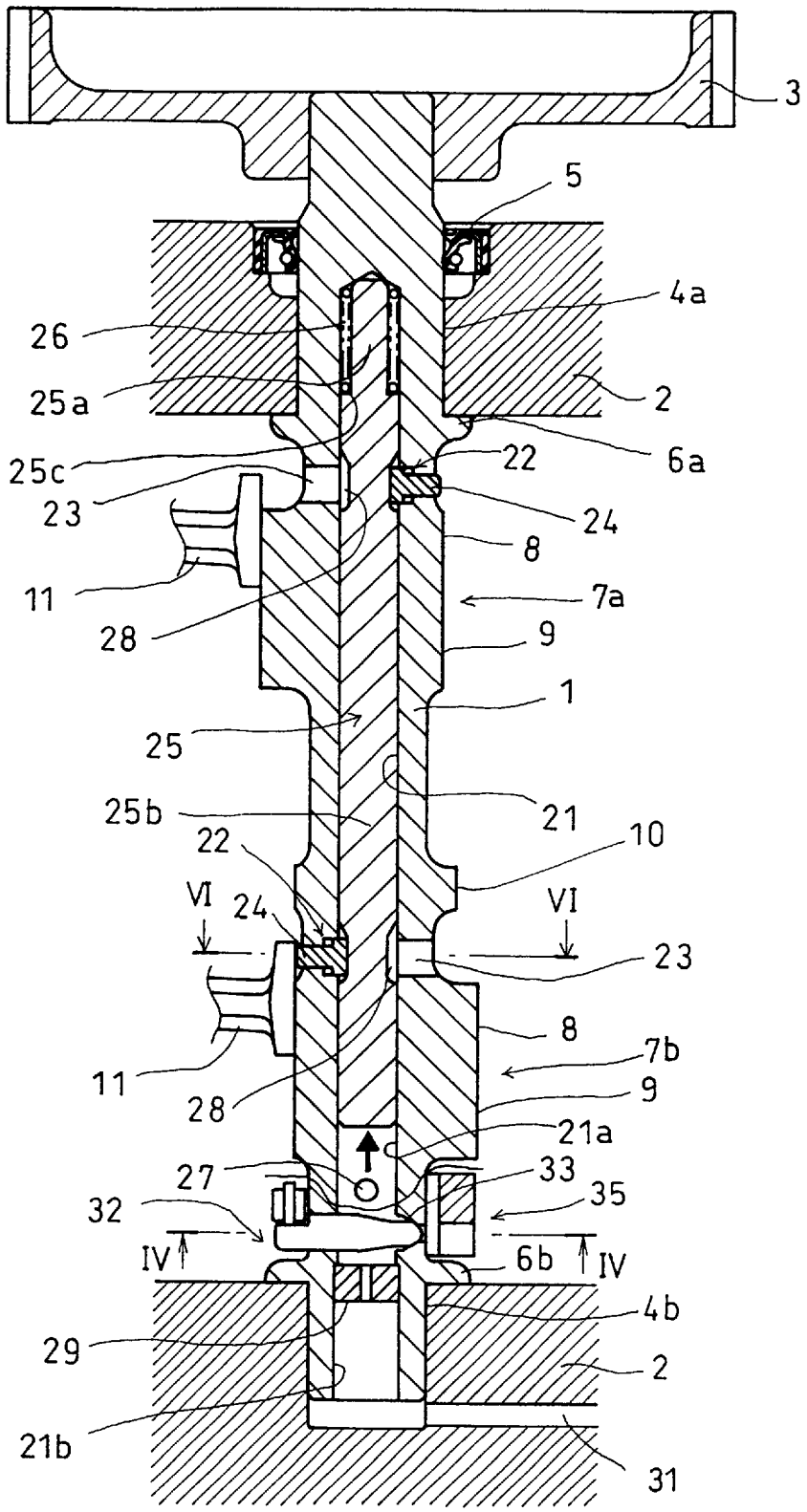
FIG. 2 is a sectional view of the decompression device showing its non-decompression state.

FIG. 1 is a sectional view of the decompression device in its decompression state and FIG. 2 is a sectional view of the decompression device in its non-decompression state.

Within the cam shaft 1 is formed an axial hole 21 extending coaxially with the cam shaft 1. The axial hole 21 extends from a lower end surface of the cam shaft 1 to the upper journal 4a and has a closed upper end and an opened lower end. This axial hole 21 is a stepped hole having a small diameter part 21*a* for fitting a decompression shaft 25 and a large diameter part 21*b* which extends from the lower end surface of the cam shaft 1 to the lower thrust receiving part 6*b*.

Figure 5:
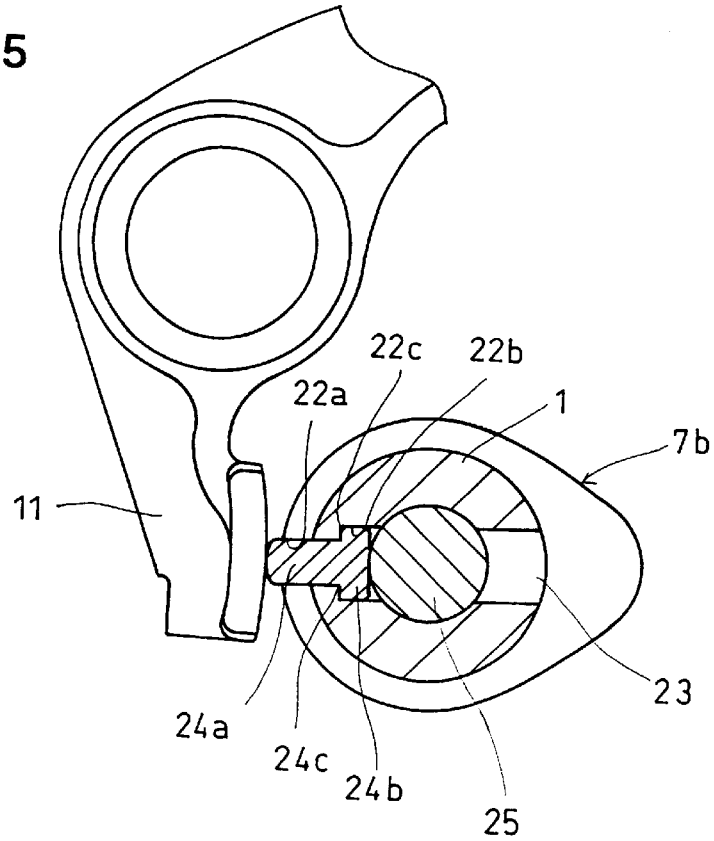
FIG. 5 is a sectional view taken along the line V—V of FIG. 1.
Figure 6:
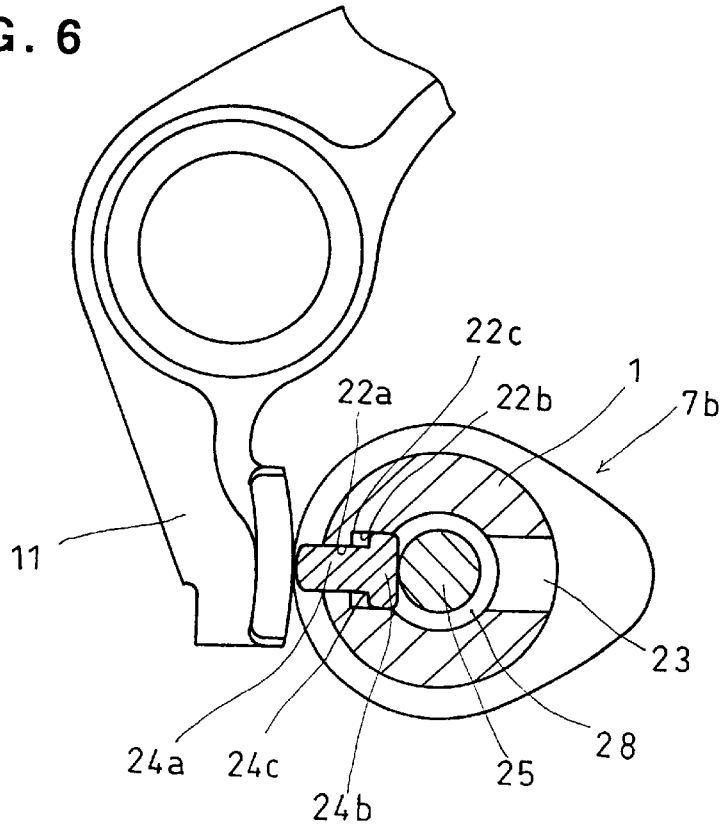
FIG. 6 is a sectional view taken along the line VI—VI of FIG. 2.

The cam shaft 1 has diametrical through holes at respective positions near tops of the exhaust cams 8 and capable of touching the exhaust rocker arms 11. Each through hole penetrate the cam shaft 1 diametrically from the nose part side of the cam forming part 7*a*, 7*b* to the base circle part side of the cam forming part 7*a*, 7*b*. As shown in FIGS. 5, 6, the base circle part side of the through hole constitutes a pin hole 22 for accommodating a decompression pin 24 which is a stepped hole having a smaller diameter part 22*a* and a larger diameter part 22*b*. The larger diameter part 22*b* extends from a peripheral surface of the small diameter part 21*a* of the axial hole 21 radially outward by a predetermined length, and the smaller diameter part 22*a* extends from the outer end of the larger diameter part 22*b* to an opening on an outer periphery of the cam shaft 1. The nose part side of the through hole constitutes an insertion hole 23 for inserting the decompression pin into the pin hole 22. The insertion hole 23 has the same diameter as that of the larger diameter part 22*b* of the pin hole 22 and extends from an outer periphery of the cam shaft 1 to the axial hole 21.

The decompression pin 24 is inserted in the pin hole 22 so as to slide in an axial direction of the pin hole 22 (a radial direction of the cam shaft). The decompression pin 24 is a stepped pin having a smaller diameter part 24*a* and a larger diameter part 24*b* each corresponding to the smaller diameter part 22*a* and the larger diameter part 22*b* of the pin hole 22. The axial length of the larger diameter part 24*b* is determined so that when an end surface of the larger diameter part 24*b* touches an outer periphery of a large diameter part 25*b* of the decompression shaft 25, a step part 24*c* of the decompression pin 24 touches a step part 22*c* of the pin hole 22*c*. And the total axial length of the decompression pin 24 is determined so that when the end surface of the larger diameter part 24*b* touches the outer periphery of the large diameter part 25*b* of the decompression shaft 25, a tip end of the smaller diameter part 24*b* projects from the base circle part of the cam forming part 7*a*, 7*b* (exhaust cam 8) radially outward by a predetermined length. This predetermined length decides the lift of the exhaust valve and is determined suitably in consideration of degree of decompression in the cylinder required in the compression stroke on engine starting.

As shown in FIGS. 1, 2, in the small diameter part 21*a* of the axial hole 21 is fitted the decompression shaft 25 so as to slidingly reciprocate axially. The decompression shaft 25 is a stepped shaft having a small diameter part 25*a* formed at the upper end and a large diameter part 25*b* formed under the part 25*a*. Between a closed upper end of the axial hole 21 and a step portion 25*c* of the decompression shaft 25 is set an axial spring 26 in a compressed condition surrounding the small diameter part 25*a* freely. The decompression shaft 25 is forced by the axial spring 26 so as to have the lower end surface touched against a stopper pin 27. The position of the decompression shaft 25 when it touches the stopper pin 27 is the first position thereof. The stopper pin 27 is fixed to the cam shaft 1 at a position below the suction cam 9 of the lower cam forming part 7*b*, diametrically crossing the axial hole 21.

The lower end surface of the decompression shaft 25 acts as a pressure receiving surface for receiving oil pressure in an oil pressure chamber 30, and when a force acting on the lower end surface based on the oil pressure becomes larger than the force of the axial spring 26, the decompression shaft 25 moves upward until the upper end surface of the small diameter part 25*a* touches the upper end of the axial hole 21 and the decompression shaft 25 stops. This position of the decompression shaft 25 when the upper end surface of the small diameter part 25*a* touches the upper end of the axial hole 21 is the second position thereof.

The large diameter part 25*b* of the decompression shaft 25 is formed with an annular groove 28 at a position opposing to the pin hole 22 when the shaft 25 is positioned at the second position. The decompression pin 24 touching the exhaust rocker arm 11 can fit in the annular groove 28 to stop opening drive of the exhaust valve by the decompression pin 24. Therefore, the depth of the annular groove 28 is set so that the tip end of the decompression pin 24 retreats radially inward of the base circle part of the cam forming part 7*a*, 7*b* (exhaust cam 8) in the state that the decompression pin 24 fits in the annular groove 28 until the end surface of the larger diameter part 24*b* touches a bottom wall surface of the annular groove 28. When the end surface of the larger diameter part 24*b* of the decompression pin 24 touches the bottom wall surface of the annular groove 28, a portion of the larger diameter part 24*b* of the decompression pin fits in the larger diameter part 22*b* of the pin hole 22.

Because the groove 28 in which the decompression pin 24 is to be fitted is annular, the position of the decompression shaft 25 is required to be adjusted in the axial direction only, regardless of its circumferential position, in spite of the pin hole 22 formed at a particular circumferential position of the cam shaft 1. Therefore, positioning of the decompression shaft 25 with respect to the pin hole 22 is easy. Even if the decompression shaft 25 rotates relatively to the cam shaft 1, the decompression pin 24 can fit in the groove surely. Further, an upper side wall surface of the annular groove 28 is inclined obliquely upward from the bottom wall surface of the groove 28 toward an outer periphery of the decompression shaft 25, so that when the decompression shaft 25 reciprocates between the first and second positions and decompression pin 24 enters and leaves the annular groove 28, the pin 24 can enter and leave smoothly utilizing the inclined upper side wall surface.

A throttle member 29 is disposed at an step portion 21*c* of the axial hole 21 and between the lower end surface of the decompression shaft 25 and an upper end surface of the throttle member 29 is formed the oil pressure chamber 30. This oil pressure chamber 30 is supplied with a pressure oil pressurized by an oil pump driven by the engine and sent through an oil passage 31 formed in the cylinder head 2 and an orifice of the throttle member 29. The oil pump generates an oil pressure proportional to the engine rotational speed and the oil pressure reaches a value capable of moving the decompression shaft 25 against force of the axial spring 25 before the engine rotational speed reaches a specific starting rotational speed predetermined for canceling the decompression action of the decompression device, regardless of temperature of the oil. The oil pump may be a trochoid pump having a rotor shaft directly connected to a lower end of the cam shaft 1.

Discharge of the pressure oil flowing into the oil pressure chamber 30 can be adjusted by changing size of the orifice formed in the throttle member 29. Therefore, by setting discharge of pressure oil from a leak hole 33 to be described later and discharge of pressure oil supplied into the oil pressure chamber 30 through the throttle member 29 suitably, even if the oil pressure generated in the oil pump is set to reach the value capable of moving the decompression shaft 25 against force of the axial spring 26 before the engine rotational speed reaches the specific starting rotational speed, when an oil pressure control valve 32 to be described later opens the leak hole 33, the oil pressure in the oil pressure chamber 30 can be set at a value capable of positioning the decompression shaft 25 at the first position surely, and when the oil pressure control valve 32 closes the leak hole 33, the decompression shaft 25 moves swiftly to occupy the second position because the oil pressure chamber 30 is filled with the oil having a pressure which has already reached the value capable of moving the decompression shaft 25.

Figure 3:
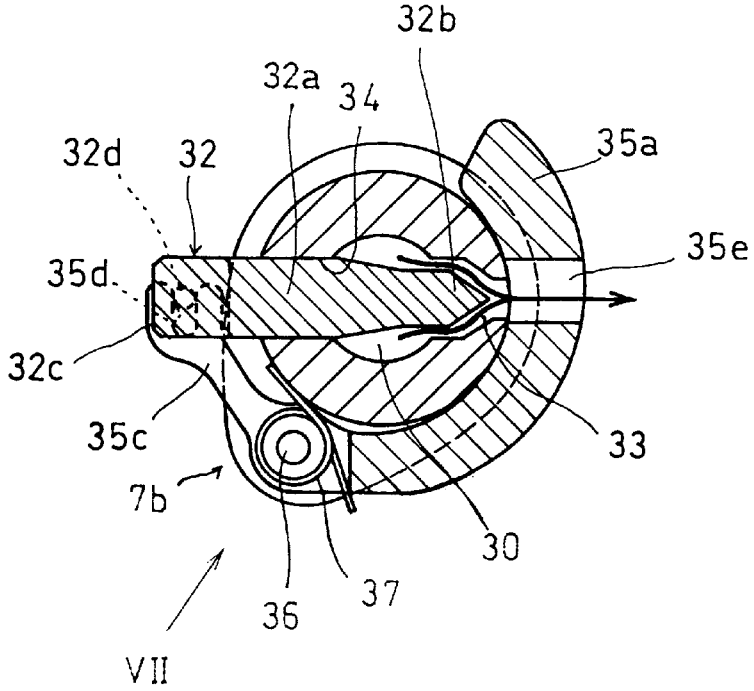
FIG. 3 is a sectional view taken along the line III—III of FIG. 1.
Figure 4:
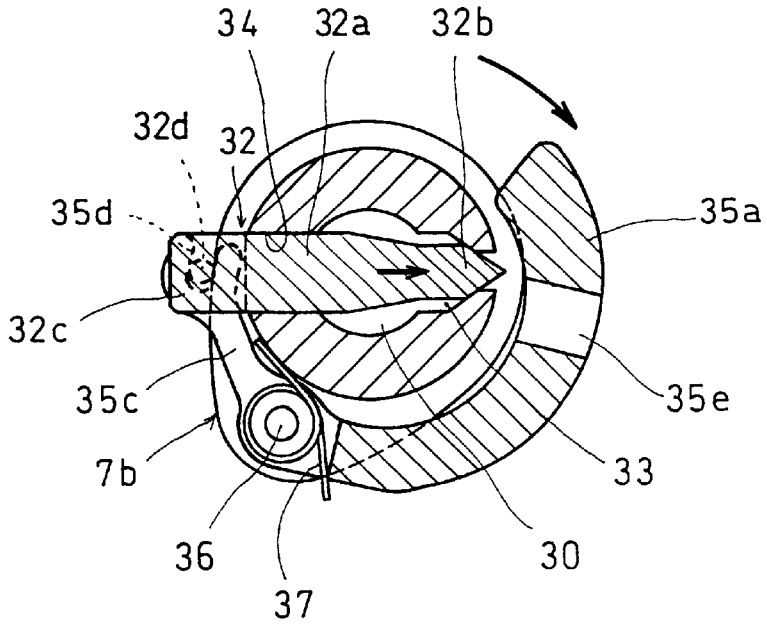
FIG. 4 is a sectional view taken along the line IV—IV of FIG. 2.
Figure 7:
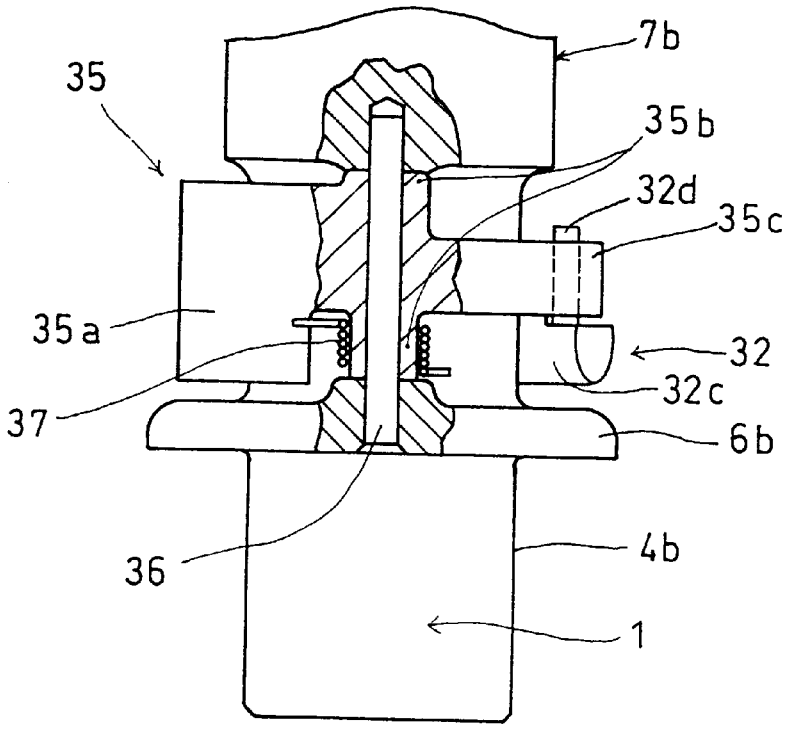
FIG. 7 is a view viewed in direction of the arrow VII of FIG. 3.

As shown in FIGS. 3, 4, the oil pressure control valve 32 comprises a cylindrical valve body part 32*a*, a conical valve part 32*b* formed at an end of the valve body part 32*a* and a cut part 32*c* formed at another end of the valve body part 32*a*. The oil pressure control valve 32 is fitted in a hole formed in the cam shaft 1 crossing the oil pressure chamber 30. The cut part 32*c* is formed by cutting out a portion of the cylinder so as to form a plane parallel with the axis of the oil pressure control valve 32 and positioned outside of the cam shaft 1 (FIG. 7). On the plane of the cut part 32*c* is planted an engaging pin 32*d* extending in parallel with the axis of the cam shaft to engage with an engaging groove 35*d* of a weight 35.

The part of the cam shaft 1 corresponding to the oil pressure chamber 30 is formed with a diametrical through hole having a center line perpendicular to the axis of the cam shaft 1 at a portion below the stopper pin 27. The through hole is composed of two holes which extend from respective ends of a diameter of the cam shaft 1 to the oil pressure chamber 30. One of the above two holes is the leak hole 33 for discharging pressure oil in the oil pressure chamber 30 outside. The leak hole 33 has a valve seat on which the valve part 32*b* of the oil pressure control valve 32 is seated to close the leak hole 33. Another hole in which the valve body part 32*a* of the oil pressure control valve 32 is slidingly fitted is a guide hole 34 for guiding the oil pressure control valve 32. A seal member may be provided between a circumferential wall surface of the guide hole 34 and an outer peripheral surface of the valve body part 32*a*.

As shown in FIGS. 3, 7, the weight 35 is composed of a weight part 35*a*, a boss part 35*b* and an arm part 35*c*. In the boss part 35*b* is inserted a support pin 36 which has an end fixed to the lower thrust receiving part 6*b* and another end fixed to the nose part of the lower cam forming part 7*b*, and the weight 35 is rotatably supported by the support pin 36. The support pin 36 is disposed in parallel with the axis of the cam shaft penetrating a hole formed in the lower thrust receiving part 6*b* and inserted in a bottomed hole formed in an lower end of the nose part of the lower cam forming part 7*b*. An upper end surface of the boss part 35*b* touches a lower end surface of the suction cam 9 of the lower cam forming part 7*b*, and a lower end surface of the boss part 35*b* touches an upper end surface of the lower thrust receiving part 6*b*. Therefore, the weight 35 can rotate without swinging up and down. On a circumference of the boss part 35*b* near the lower thrust receiving part 6*b* is loosely fitted a weight spring 37. An end of the weight spring 37 touches an outer periphery of the cam shaft 1 and another end of the spring 37 touches an end portion of the weight part 35*a*, so that the weight 35 is forced by torsional spring force of the spring 37 so as to bring an inner periphery of the weight part 35*a* into contact with an outer periphery of the cam shaft 1.

The weight part 35*a* is shaped semicircular and extends from the boss part 35*b* along an outer periphery of the cam shaft 1 at a height between the lower thrust receiving part 6*b* and the lower cam forming part 7*b*. The weight part 35*a* is formed with a radial discharge hole 35*e* to allow free discharge of oil from the leak hole 33. The discharge hole 35*e* is opposite to the leak hole 33 when the inner periphery of the weight part 35*a* touches the outer periphery of the cam shaft 1.

The arm part 35*c* extends along an outer periphery of the cam shaft 1 from the boss part 35*b* in the opposite direction to the weight part 35*a*. At a tip end of the arm part 35*c* is formed a U-shaped engaging groove 35*d* which engages with the engaging pin 32*d* of the oil pressure control valve 32.

Therefore, the oil pressure control valve 32 is interlocked with the weight 35 by means of the engaging groove 35*d* and the engaging pin 32*d* so that the oil pressure control valve 32 is moved by the weight 35 which is rotated about the supporting pin 36 by the centrifugal force generated in accordance with rotation of the cam shaft.

When the engine rotational speed is below the specific starting rotational speed, since a moment about the support pin 36 generated by the centrifugal force acting on the weight part 35*a* is not larger than a moment about the support pin 36 generated by the spring force of the weight spring 37, the weight 35 rests on the cam shaft 1 in a state that the inner periphery of the weight part 35*a* touches the outer periphery of the cam shaft 1 and the discharge hole 35 is aligned with the leak hole 33. At that time, the engaging groove 35*d* and the engaging pin 32*d* engage with each other in a manner that the oil pressure control valve 32 opens the leak hole 33.

When the engine rotational speed exceeds the specific starting rotational speed, the moment about the support pin 36 generated by the centrifugal force acting on the weight part 35*a* becomes larger than the moment about the support pin 36 generated by the spring force of the weight spring 37, and the weight 35 rotates to separate the inner periphery of the weight part 35*a* from the outer periphery of the cam shaft 1. At this time, the arm part 35*c* of the weight 35 rotates to approach the outer periphery of the cam shaft 1 and, owing to the engagement of the engaging groove 35*d* and the engaging pin 32*d*, the oil pressure control valve 32 moves toward the valve seat to close the leak hole 33.

Thus, the weight 35 constitutes a mechanism for detecting the engine rotational speed, and further a mechanism for driving the oil pressure control valve 32.

When the engine is stopped, the inner periphery of the weight part 35*a* is pushed against the outer periphery of the cam shaft 1 by the torsional spring force of the weight spring 37 and the oil pressure control valve 32 is held at a position apart from the valve seat to open the leak hole 33. The decompression shaft 25 is positioned at the first position by the spring force of the axial spring 26.

When the engine is started by the recoil starter, rotation of the crankshaft is transmitted to the cam shaft 1 through the timing belt to rotatively drive the cam shaft 1, and also the oil pump is driven. Pressure oil pumped out by the oil pump is supplied under the cam shaft 1 through the oil passage 31 and further into the oil pressure chamber 30 through the throttle member 29.

During this engine starting period, the engine rotational speed is low and therefore the centrifugal force generated on the weight part 35*a* by rotation of the cam shaft 1 is small. Accordingly, the moment about the support pin 36 generated by the centrifugal force acting on the weight part 35*a* is smaller than the moment generated by the torsional spring force of the weight spring 37, so that the weight 35 and the oil pressure control valve 32 is kept in the same state as when the engine is stopped. Therefore, pressure oil flowing into the oil pressure chamber 30 is discharged outside through the opened leak hole 33. This discharged oil can be utilized for lubricating the neighborhood of the cam shaft 1.

Oil pressure generated in the oil pump increases in proportion to the engine rotational speed, but flow rate of the pressure oil flowing in the oil pressure chamber 30 is adjusted by the throttle member 29 in consideration of flow rate of the pressure oil flowing out through the opened leak hole 33 so that the oil pressure in the oil pressure chamber 30 cannot move the decompression shaft 25 axially. Namely, so far as the leak hole 33 is opened, no oil pressure capable of moving the decompression shaft 25 upward against the force of the axial spring exists in the oil pressure chamber 30, regardless of oil pressure generated in the oil pump. As the result, the decompression shaft 25 is positioned at the first position as shown in FIG. 1, and the decompression pin 24 touches the outer periphery of the decompression shaft 25 with the tip end of the smaller diameter part 24*a* projecting from the base circle part of the cam forming part 7*a*, 7*b* radially outward by a predetermined length. Therefore, as shown n FIG. 5, in the compression stroke of the engine, the exhaust valve is opened with a lift corresponding to the above predetermined length to reduce the compression pressure in the cylinder.

When the engine has been started to operate by itself and the engine rotational speed reaches and exceeds the specific starting rotational speed, the moment about the support pin 36 generated by the centrifugal force of the weight 35 becomes larger than the moment generated by the torsional force of the weight spring 37, therefore the weight 35 rotates about the support pin 36 to push the engaging pin 32*d* through the engaging groove 35*d*, and the valve part 32*b* of the oil pressure control valve 32 moves toward the valve seat to close the leak hole 33.

At that time, oil pressure generated in the oil pump has already reached a value capable of moving the decompression shaft 25 against the spring force of the axial spring 26 and the oil pressure chamber 30 is filled with pressure oil having the same pressure, so that the decompression shaft 25 moves swiftly upward against the spring force of the axial spring 26 to occupy the second position as shown in FIG. 2. In this state, the bottom of the larger diameter part 24*b* of the decompression pin 24 is opposite to the annular groove 28. Therefore, when the exhaust rocker arm 11 touches the tip end of the decompression pin 24 in the compression stroke of the piston, the decompression pin 24 fits in the annular groove 28 as shown in FIG. 6, so that the exhaust valve is not opened and the decompression action is canceled.

After that time, so far as the engine is operated with an engine rotational speed above the specific starting rotational speed, the oil pressure valve 32 is continuously pushed against the valve seat by the weight 35 to keep the leak hole in closed state.

The above-mentioned decompression device is effective as follows.

The decompression device is smaller than a conventional decompression device having a decompression pin moved by centrifugal force of a weight, because position of the decompression shaft 25 is controlled by oil pressure in the oil pressure chamber 30 supplied with pressure oil of the oil pump. Further, because the oil pressure control valve 32 moves in accordance with movement of the weight 35 which rotates in accordance with the engine rotational speed, namely the oil pressure control valve 32 is controlled in accordance with the engine rotational speed, when the engine rotational speed exceeds the specific starting rotational speed the oil pressure control valve 32 acts to set the oil pressure in the oil pressure chamber 30 at a value capable of positioning the decompression shaft 25 at the second position and stops opening drive of the exhaust valve by the decompression pin 24. Therefore, the decompression action can be canceled surely at a predetermined engine rotational speed to enable a stable engine starting.

Since the weight 35 is rotatably supported by the support pin 36 fixed to the cam shaft 1, and the oil pressure control valve 32 moves following movement of the weight 35 which is rotated by centrifugal force generated in accordance with the engine rotational speed, it is possible to let the oil pressure control valve 32 operate in accordance with the engine rotational speed by a simple construction utilizing the weight 35. Further , since the weight 35 is only required to drive the oil pressure control valve 32 and therefore it may be a small one, the decompression device can be made small and light in spite of using the weight 35.

Since the oil pressure in the oil pressure chamber 30 is controlled by opening or closing the leak hole 33 by the oil pressure control valve 32, generation and release of the oil pressure in the oil pressure chamber 30 can be carried out easily, and the pressure oil discharged through the leak hole 33 can be utilized to lubricate the neighborhood of the cam shaft 1.

The pin hole 22 is formed at a particular circumferential position of the cam shaft 1 radially, but the groove 28 formed on the decompression shaft 25 is annular. Therefore, positioning of the decompression shaft 25 is required to be carried out only in the axial direction regardless of its circumferential position, so that positioning of the decompression shaft 25 is easy and the decompression pin 24 can be fitted in the groove surely even if the decompression shaft 25 rotates relatively to the cam shaft 1.

Since the upper side wall surface of the annular groove 28 is inclined obliquely upward from the bottom wall surface of the annular groove 28 toward the outer periphery of the decompression shaft 25, the decompression pin 24 can come in and go out of the annular groove 28 smoothly utilizing the inclined upper side wall surface when the decompression shaft 25 reciprocates between the first and second positions.

Since the oil pressure chamber 30 having the leak hole 33 is supplied with pressure oil from the oil pump driven by the engine through the throttle member 29, by setting discharge of pressure oil from the leak hole 33 and discharge of pressure oil supplied into the oil pressure chamber 30 through the throttle member 29 from the oil pump generating oil pressure proportional to the engine rotational speed suitably, even if the oil pressure generated in the oil pump reaches a value capable of moving the decompression shaft 25 before the engine rotational speed reaches the specific starting rotational speed, when the oil pressure control valve 32 opens the leak hole 33, the oil pressure in the oil pressure chamber 30 can be easily set at a value capable of positioning the decompression shaft 25 at the first position, and when the oil pressure control valve 32 closes the leak hole 33, the oil pressure in the oil pressure chamber 30 can be swiftly set at a value capable of positioning the decompression shaft 25 at the second position.

In the above-mentioned embodiment, the internal combustion engine is mounted on an outboard motor, but it may be mounted on facilities other than the outboard motor such as a vehicle or the like. A kick starter may be used in place of the recoil starter in the above-mentioned embodiment.

Though the cam shaft 1 is formed with both the exhaust cam 8 and the suction cam 9 in the above-mentioned embodiment, the cam shaft may be formed with only the exhaust cam.

In the above-mentioned embodiment, the axial length of the larger diameter part 24*b* of the decompression pin 24 is set so that when the bottom surface of the larger diameter part 24*b* touches an outer periphery of the large diameter part 25*b* of the decompression shaft 25, the step part 24*c* of the decompression pin 24 touches the step part 22*c* of the pin hole 22. However, in the state that the bottom surface 24*c* of the larger diameter part 24*b* touches the outer periphery of the large diameter part 25*b* of the decompression shaft 25, a space may be formed between the step part 24*c* of the decompression pin 24 and the step part 22*c* of the pin hole 22, and a spring for forcing the decompression pin 24 axially inward may be provided in the space. The spring pushes the decompression pin 24 against the bottom wall surface of the annular groove 28.

What is claimed is:

1. A decompression device of a four-stroke-cycle internal combustion engine, comprising:

a cam shaft having an exhaust cam for driving an exhaust valve to open and formed with an axial hole;

an oil pressure chamber formed in said axial hole to be supplied with pressure oil;

a decompression shaft fitted in said axal hole to be positioned at one of a first position and a second position corresponding to oil pressure in said oil pressure chamber;

a decompression pin which drives said exhaust valve to open in compression stroke of said engine when said decompression shaft is positioned at said first position and stops to drive said exhaust valve when said decompression shaft is positioned at said second position; and an oil pressure control valve by which oil pressure in said oil pressure chamber is set to a pressure for positioning said decompression shaft at said first position when rotational speed of said engine is below a specific starting rotational speed or to a pressure for positioning said decompression shaft at said second position when rotational speed of said engine is above said specific starting rotational speed.

2. A decompression device of a four-stroke-cycle internal combustion engine as claimed in claim 1, wherein said oil pressure chamber has a leak hole for discharging pressure oil in said pressure oil chamber to an outside of said cam shaft, and said oil pressure control valve opens said leak hole when said engine rotational speed is below said specific starting rotational speed and closes said leak hole when said engine rotational speed is above said specific starting rotational speed.

3. A decompression device for a of a four-stroke-cycle internal combustion engine as claimed in claim 2, wherein said oil pressure control valve is interlocked with a weight rotatively supported by a support pin fixed to said cam shaft to be rotated by centrifugal force generated in accordance with said engine rotational speed, thereby, said leak hole is opened by movement of said weight when said engine rotational speed is below said specific starting rotational speed, and closed by movement of said weight when said engine rotational speed is above said specific starting rotational speed.

4. A decompression device of a four-stroke-cycle internal combustion engine as claimed in claim 2 or 3, wherein said decompression pin is inserted in a pin hole formed in said cam shaft radially, said decompression shaft can reciprocate axially and has an annular groove formed in a position opposing to said pin hole when said decompression shaft positions at said second position, further, said decompression pin touches an outer periphery of said decompression shaft to project radially outward of a base circle part of said exhaust cam when said decompression shaft is at said first position, and fits in said annular groove to retreat radially inward of said base circle part when said decompression shaft is at said second position.

5. A decompression device of a four-stroke-cycle internal combustion engine as claimed in claim 2 or 3, wherein said oil pressure chamber is supplied with pressure oil from an oil pump driven by said engine through a throttle member.

* * * * *